US006296415B1

(12) United States Patent
Johnson et al.

(10) Patent No.: US 6,296,415 B1
(45) Date of Patent: Oct. 2, 2001

(54) CAM TYPE HUB AND STRUT FOR USE IN PORTABLE AND SEMI-PERMANENT STRUCTURES

(75) Inventors: Brooks E. Johnson, Becker; Keith J. Beam, Brooklyn Park, both of MN (US)

(73) Assignee: Double Bull Archery, LLC, Monticello, MN (US)

( * ) Notice: Subject to any disclaimer, the term of this patent is extended or adjusted under 35 U.S.C. 154(b) by 0 days.

(21) Appl. No.: 09/300,677

(22) Filed: Apr. 27, 1999

(51) Int. Cl.[7] ..... E04H 15/00

(52) U.S. Cl. ..... 403/170; 403/93; 135/98; 135/901

(58) Field of Search ..... 403/170, 174, 403/217, 218, 56, 114, 115, 93, 94, 96; 160/370.21, 351; 135/98, 901

(56) References Cited

U.S. PATENT DOCUMENTS

| | | | | |
|---|---|---|---|---|
| 3,810,482 | * | 5/1974 | Beavers | 403/217 X |
| 3,941,140 | | 3/1976 | Beavers . | |
| 4,077,417 | | 3/1978 | Beavers . | |
| 4,606,669 | * | 8/1986 | DeBliquy | 403/170 |
| 4,637,748 | * | 1/1987 | Beavers | 403/170 |
| 4,941,499 | * | 7/1990 | Pelsue et al. | 403/93 X |
| 5,069,572 | | 12/1991 | Niksic . | |
| 5,628,338 | | 5/1997 | Stumbo . | |
| 5,943,837 | * | 8/1999 | Esser et al. | 403/170 X |
| 5,944,041 | * | 8/1999 | Kitchens | 135/98 X |

* cited by examiner

*Primary Examiner*—Lynne H. Browne
*Assistant Examiner*—David E. Bochna
(74) *Attorney, Agent, or Firm*—Hugh D. Jaeger

(57) ABSTRACT

A cam style hub and strut system for use in single panel fabric, cloth, or plastic units, or structures with an unlimited number of wall and/or roof panels. The purpose of the cam style hub is to compensate for certain fabric characteristics and to allow easier setup of structures containing flexible or rigid support struts connected to a central hub by lessening the distance of the diametrically opposing struts during assembly, and applying the force necessary to engage the self-supporting structure by engaging the cam, increasing the distance between the ends of the opposing struts. The amount the distance is increased can be dictated by materials used and the size of the panel. The hub may contain an optional "locking" feature activated when the hub cam is engaged for convenience and safety reasons. The principle can be used with any number of struts greater than one.

1 Claim, 10 Drawing Sheets

CAM TYPE HUB AND STRUT FOR USE IN PORTABLE AND SEMI-PERMANENT STRUCTURES

CROSS REFERENCES TO CO-PENDING APPLICATIONS

None.

BACKGROUND OF THE INVENTION

1. Field of the Invention

The present invention is for a support system, and more particularly, pertains to a cam style hub and strut system for use in portable and semi-permanent structures. The present invention can be used in any number of structures, including but not limited to, portable or semi-permanent structures, such as ice fishing houses, movie screens, road crew signs, boat covers, tents, medical tents, hunting blinds, photography blinds, portable garages, and the like.

2. Description of the Prior Art

Portable or semi-permanent structures are popular and practical for many of the aforementioned applications. The shortcomings of the current art device centrally hubbed units lie in the impracticality of utilizing the proper amount of extra diagonal length between the rod or strut ends and the distance between corners of a panel. The diagonal distance between opposing strut ends must be sufficiently greater than the corresponding corner-to-corner measurement of the panel in order to hold the panel in place once the hub is forced through the center. When the struts used are of optimal length, the unit becomes very difficult to set up, and damage to the hub system or structure itself frequently occurs. Couple this with the fact that many optimal structural fabrics stretch and shrink when contacted with environmental conditions to which they are commonly exposed, for example, rain, high humidity, heat, sunlight, and the like, the optimal system then is one that can be adjustable. In systems utilizing fabrics prone to stretching or shrinking, the unit may be built so that the cam need only be engaged in conditions in which the fabric is found to be affected. This system couples ease of setup with the cam disengaged and application of the proper amount of pressure on the panel to hold the system in a fixed position with the cam engaged, utilizing either flexible or rigid struts depending upon the properties of the material used in the panel and the size of the panel.

SUMMARY OF THE INVENTION

The present invention incorporates a cam style hub and strut system with offset pivot points in the hub that when turned moves the opposing struts to a lineal orientation furthering the distance between the strut ends. This allows ease of setup partnered with the ability to apply a greater amount of diagonal force upon the panel in which they are installed, creating panels used in structures that were formerly prone to failure caused by (1) the forces exerted in erection, (2) changes in environmental conditions, (3) excessive wind or wind flap, specifically in wildlife concealment applications (wind flap equates to failure), (4) injury from sudden accidental collapse, and (5) inability to erect. The cam style hub also eliminates the need for excessive panel construction costs associated with current techniques incorporating elastic perimeters, no-stretch perimeters, spring-loaded strut end caps, and the use of various sizes of struts needed to match panel material weights and stretch properties. The framework of the cam need not go past 180 degrees and may incorporate a locking mechanism, if desired. The diagonal length of the struts is greater than the diagonal of the panel. The locking mechanism makes it possible to use same length struts if desired, meaning struts will not bow and the structure will stay up.

According to one embodiment of the present invention, there is provided a cam style hub and strut system, including a centrally located rotatable hub having a plurality of positionable struts extending outwardly therefrom to engage the outer regions of a flexible panel of cloth, tent material, canvas, sheet plastic or the like.

One significant aspect and feature of the present invention is a cam style hub and strut system having a centrally located rotatable hub which operates two or more struts outwardly. The cam style hub and strut system includes sockets which accommodate the ball ends of the outwardly extendable struts. The cam style hub and strut system incorporates over-the-center locks.

Another significant aspect and feature of the present invention is a cam style hub and strut system incorporating capture detents to lock the struts in the extended position.

Yet another significant aspect and feature of the present invention is a cam style hub and strut system having accommodational maneuvering channels, truncated slots and capture detents in which the struts can be positioned, maneuvered and locked or collapsed.

A further significant aspect and feature of the present invention is a cam style hub and strut system in which the struts are collapsible when not in use.

Having thus described one or more embodiments of the present invention, it is the principal objective hereof to provide a cam style hub and strut system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
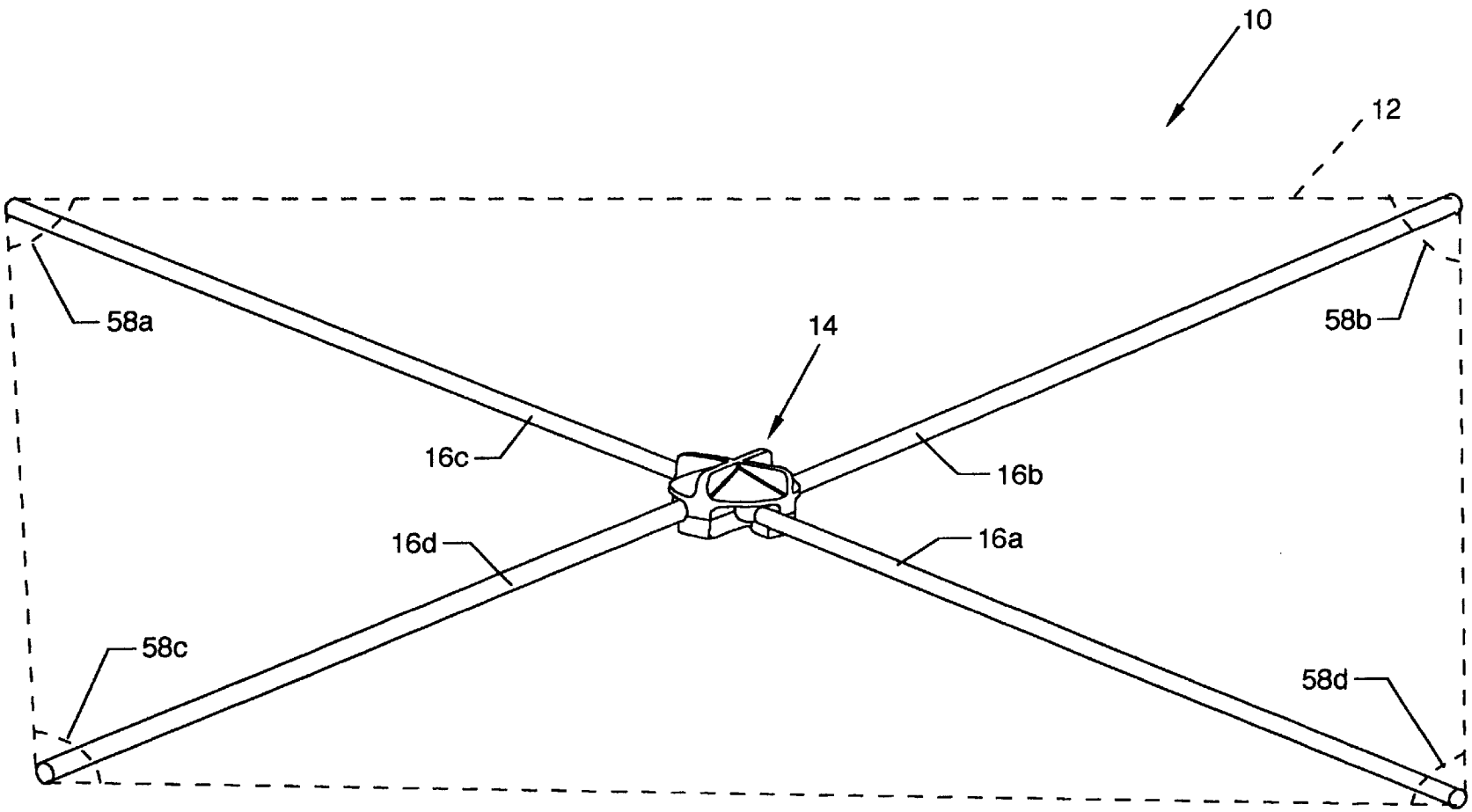
FIG. 1 illustrates a cam style hub and strut system, the present invention, engaging a portable or semi-permanent panel.

FIG. 1 illustrates a cam style hub and strut system 10, the present invention, engaging a portable or semi-permanent panel 12 shown in dashed lines. Although only one cam style hub and strut system 10 is shown engaging one panel, it should be appreciated that a plurality of panels such as panel 12 can be incorporated in juxtaposition to form a portable or semi-permanent structure incorporating several of the cam style hub and strut systems 10. The cam style hub and strut system 10 includes a cam style hub herein called the hub 14 preferably of Zytel or other suitable plastic, metal, or suitable material. A plurality of struts 16*a,* 16*b,* 16*c* and 16*d* extend forcibly and outwardly from the hub 14 to engage the corners of the panel 12 to stretch or otherwise suitably form or shape the panel 12. Pockets 58*a*–58*d* are sewn or glued onto ends of the panel 12 material for receiving the strut ends. In the alternative, any suitable panel fastening structure can be secured onto the ends of the struts by any suitable known process, such as glue, adhesives, lacing composed of string or thread, or even hook and loop materials. The struts 16*a*–16*d* are of flexible or rigid construction such as, but not limited to, fiberglass, plastic, steel rod and the like. The panel fastening structure can be on the panel, the struts, or both.

Figure 2:
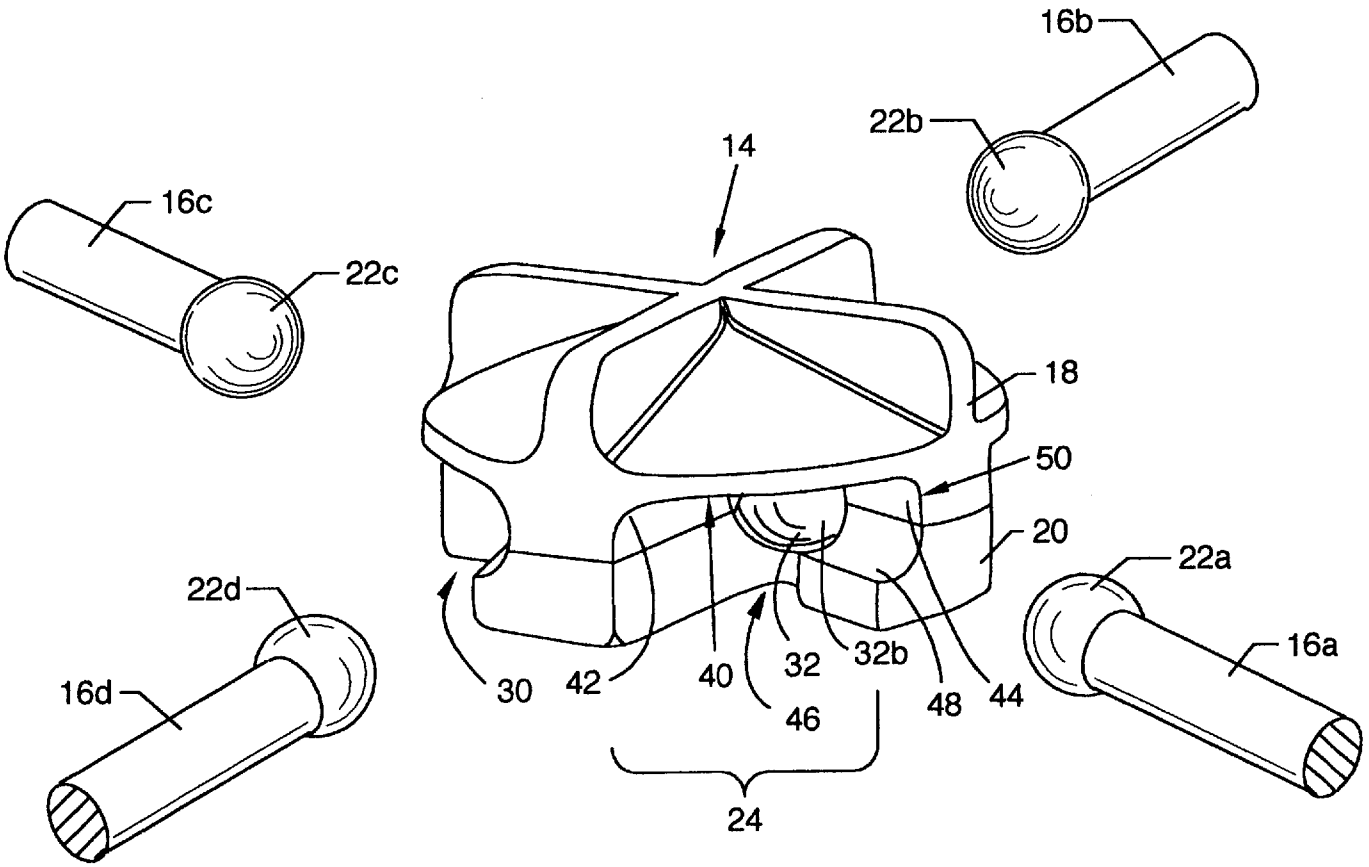
FIG. 2 illustrates an isometric view of the hub and the inboard ends of the struts.
Figure 4:
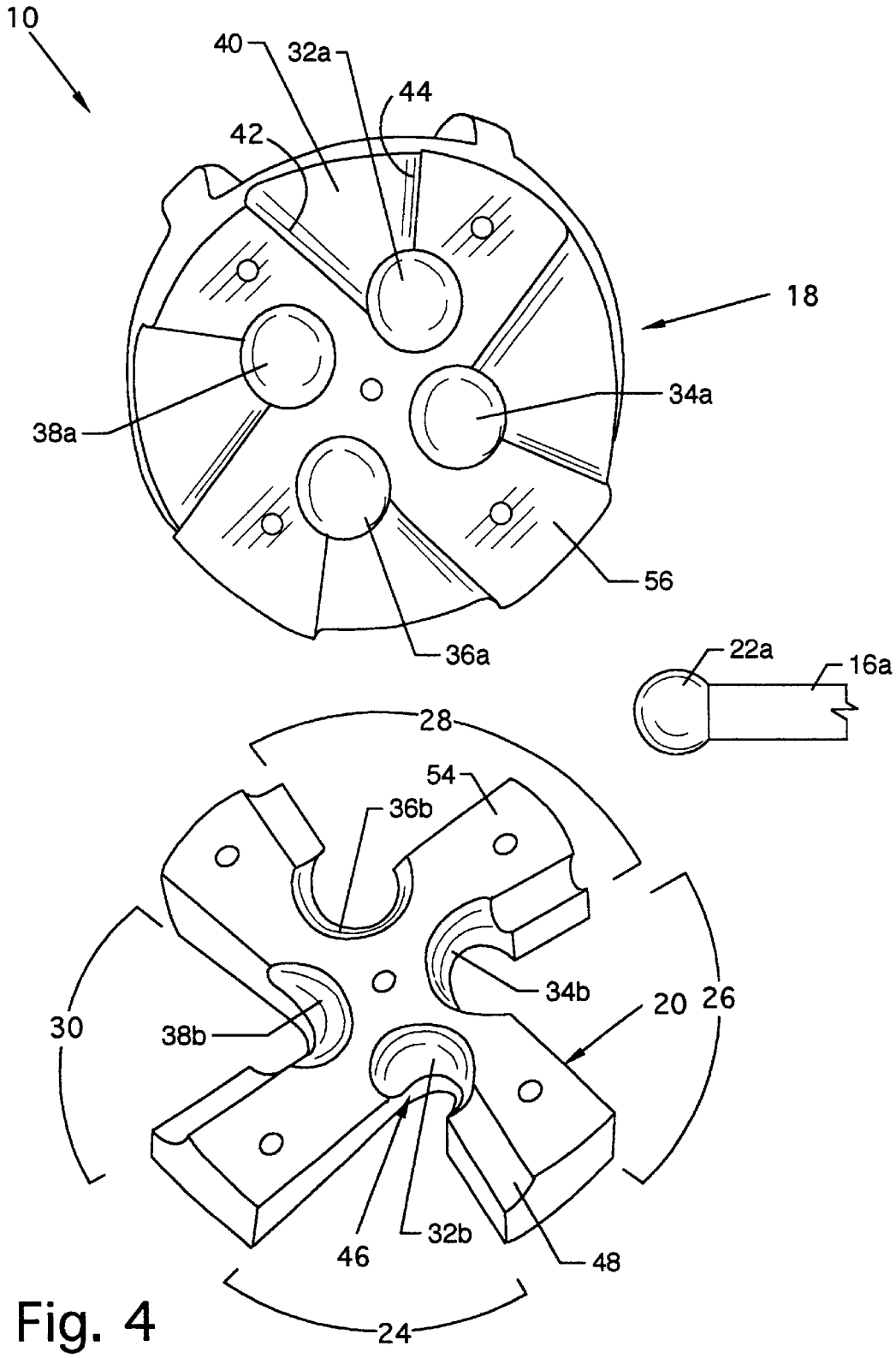
FIG. 4 illustrates an isometric view of the capture plate with the actuator handle rotated at an angle with respect to the capture plate to reveal the inwardly facing planar surfaces of the capture plate and the actuator handle.
Figure 6:
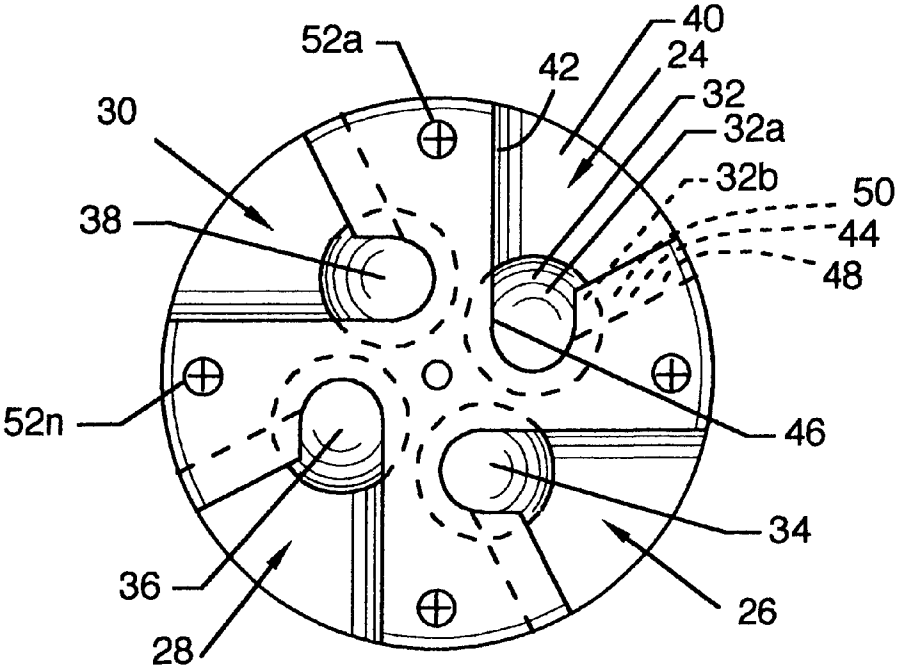
FIG. 6 illustrates a bottom view of the hub.

FIG. 2 illustrates an isometric view of the hub 14 and the inboard ends of the struts 16*a*–16*d*. The hub 14 is a split and subsequently mated assembly having a configured actuator handle 18 and a configured capture plate 20. The actuator handle 18 and the capture plate 20 secure over and about and capture the ball ends 22*a*, 22*b*, 22*c* and 22*d* of the struts 16*a*, 16*b*, 16*c* and 16*d*, respectively, which are shown for clarity exterior to the hub 14. A plurality of accommodational maneuvering channels 24, 26, 28 and 30 are located and formed between the actuator handle 18 and the capture plate 20. The accommodational maneuvering channels 24, 26, 28 and 30 are spaced at 90 degree intervals with respect to each other to intersect sockets 32, 34, 36 and 38, respectively, within the hub 14, as partially illustrated in this figure and as illustrated in FIG. 6 and other figures as required. Movement of the ball ends 22*a*, 22*b*, 22*c* and 22*d* of the struts 16*a*, 16*b*, 16*c* and 16*d* within the accommodational maneuvering channels 24, 26, 28 and 30 is best understood by further description of the accommodational maneuvering channels 24, 26, 28 and 30. Accommodational maneuvering channel 24, being in all respects similar to and having features and components similar to accommodational maneuvering channels 26, 28 and 30 is now described. Reference is also made to FIGS. 4 and 6 wherein accommodational maneuvering channel 24 extends substantially horizontally within the hub 14 and is substantially V-shaped and, in the actuator handle 18, includes a horizontally aligned planar surface 40 between an inwardly extending arced surface 42 and another inwardly extending arced surface 44. The planar surface 40 and arced surfaces 42 and 44 form a contiguous surface which intersects an upper and partial socket portion 32*a*. In the capture plate 20 a truncated slot 46 extends inwardly in juxtaposition with the arced surface 42 to intersect a lower and partial socket portion 32*b*. Also intersecting the lower and partial socket portion 32*b* is an inwardly extending arced surface 48 which juxtaposes the arced surface 44 of the actuator handle 18. The arced surface 48 is slightly greater than 450 and the arced surface 44 is 45° which in combination forms an arc of just slightly more than 90° which provides for a low pressure capture detent 50 useful for snap-engagement of the strut 16*a* within the capture detent 50 during operation of the invention. The ball end 22*a* is captured during assembly of the actuator handle 18 and the capture plate 20.

With respect to the horizontal, the strut 16*a* can be accommodated and maneuvered horizontally about the intersection of the ball end 22*a* and the socket 32. Horizontal movement of the strut 16*a* is allowed along the planar surface 40 and between the arced surface 42 and the capture detent 50. Capture of the strut 16*a* within the capture detent 50 discourages horizontal movement and restricts vertical maneuvering of the strut 16*a*. With respect to the vertical positioning of the strut 16*a* such as for collapsing of the cam style hub and strut system 10 and associated panel 12, the strut 16*a* must be maneuvered and positioned out of the capture detent 50 and aligned to the arced surface 42 which also places the strut 16*a* in alignment with the truncated slot 46 whereby the strut may be rotatingly positioned along the truncated slot 46 and maneuvered vertically, thereby placing the axis of the strut 16*a* perpendicular to the hub 14.

Figure 3:
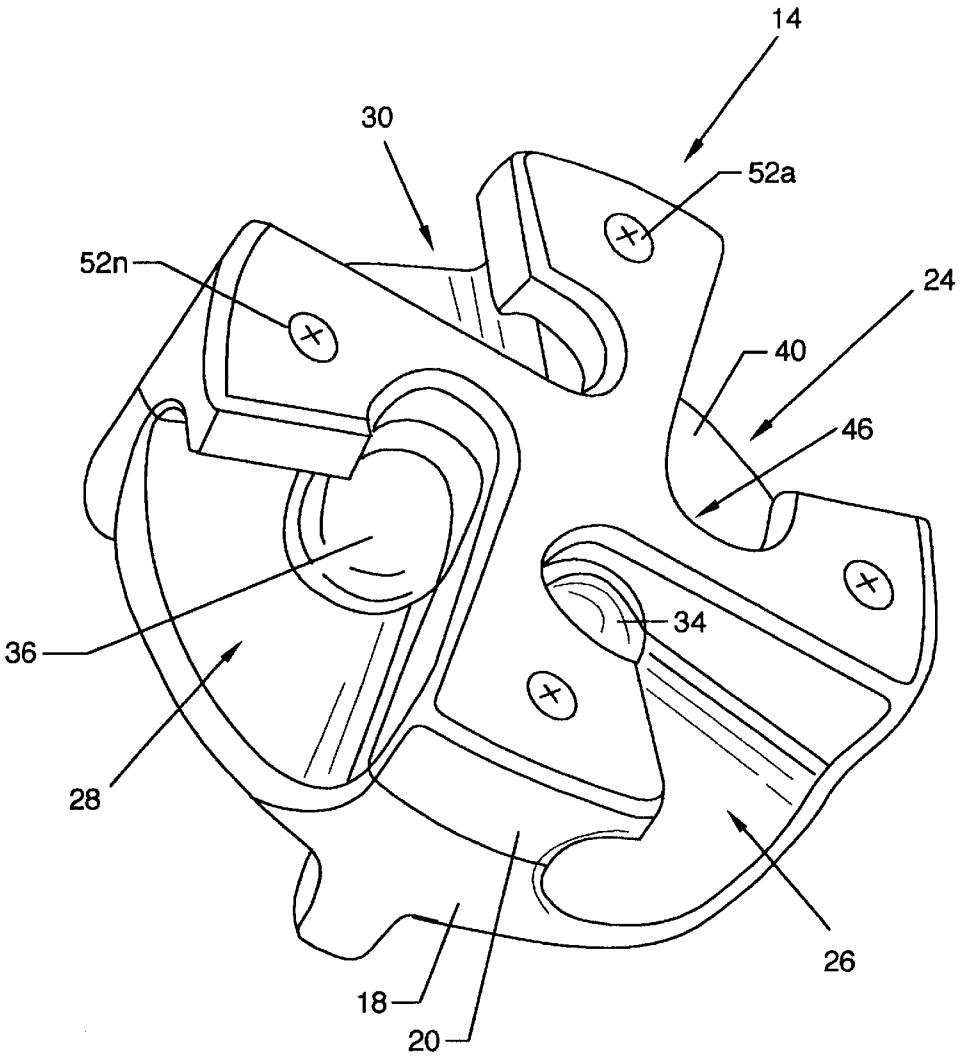
FIG. 3 illustrates a perspective and inverted bottom view of the hub.

FIG. 3 illustrates a perspective and inverted bottom view of the hub 14. Illustrated in particular is the truncated slot 46 typical to other truncated slots in the invention. Also visible are the heads of a plurality of screws 52*a*–52*n* which secure the capture plate 20 to the actuator handle 18. Other securing processes can include gluing, adhesives, welding, snap-fit, etc.

FIG. 4 illustrates an isometric view of the capture plate 20 with the actuator handle 18 rotated at an angle with respect to the capture plate 20 to reveal the inwardly facing planar surfaces 54 and 56, respectively, of the capture plate 20 and the actuator handle 18. Illustrated in particular is the upper and partial socket portion 32*a* in the actuator handle 18 and the lower and partial socket portion 32*b* in the capture plate 20 which in joined and mated combination form the socket 32. In a similar fashion, planar surface 56 on the lower region of the actuator handle 18 aligns and mates to a corresponding planar surface 54 on the upper region of the capture plate 20 to additionally align upper and partial socket portions 34*a,* 36*a* and 38*a* of the actuator handle 18 with the corresponding lower and partial socket portions 34*b,* 36*b* and 38*b* of the capture plate 20 to form sockets 34, 36 and 38.

Figure 5:
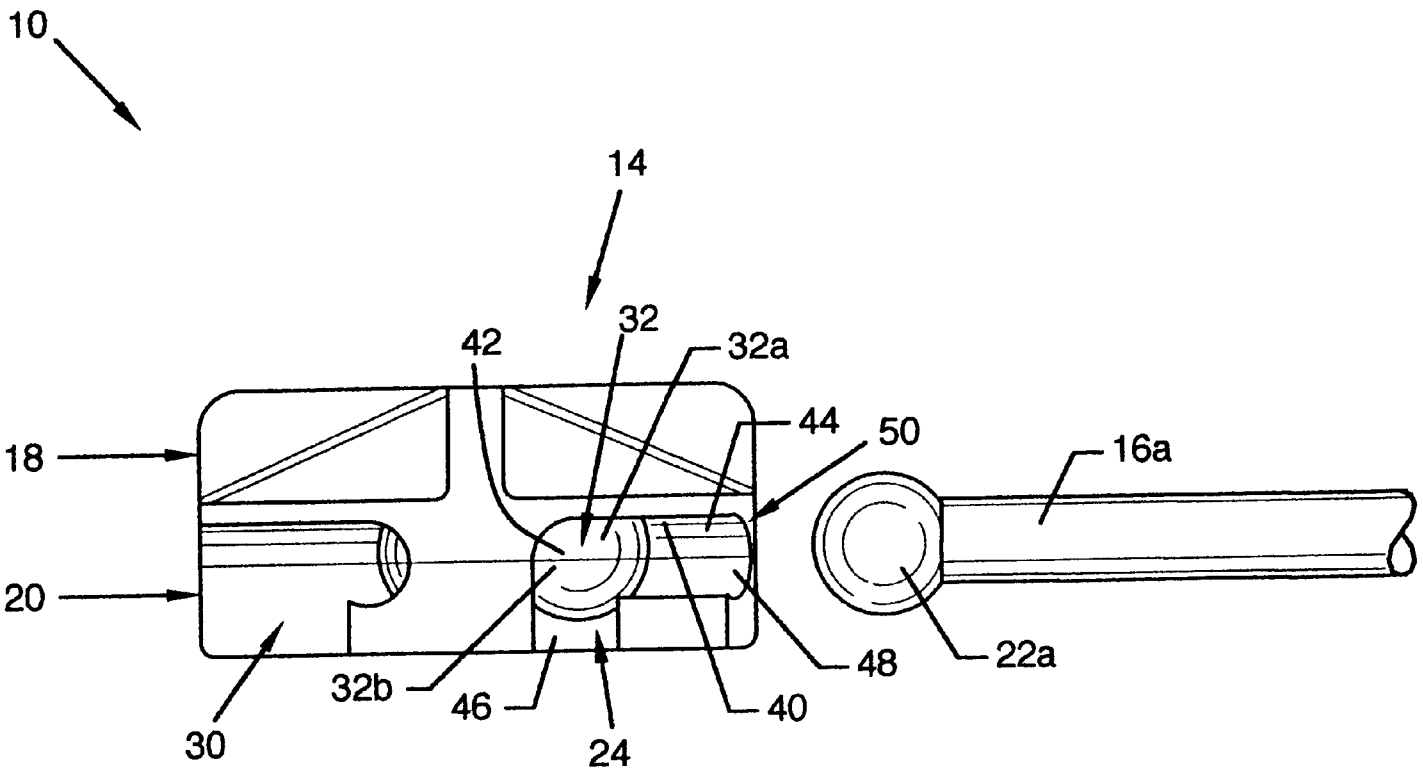
FIG. 5 illustrates a side view of the hub and an actuator strut end.

FIG. 5 illustrates a side view of the hub 14 and an end of actuator strut 16*a*, where all numerals correspond to those previously described.

FIG. 6 illustrates a bottom view of the hub 14, where all numerals correspond to those previously described.

MODE OF OPERATION

Figure 7:
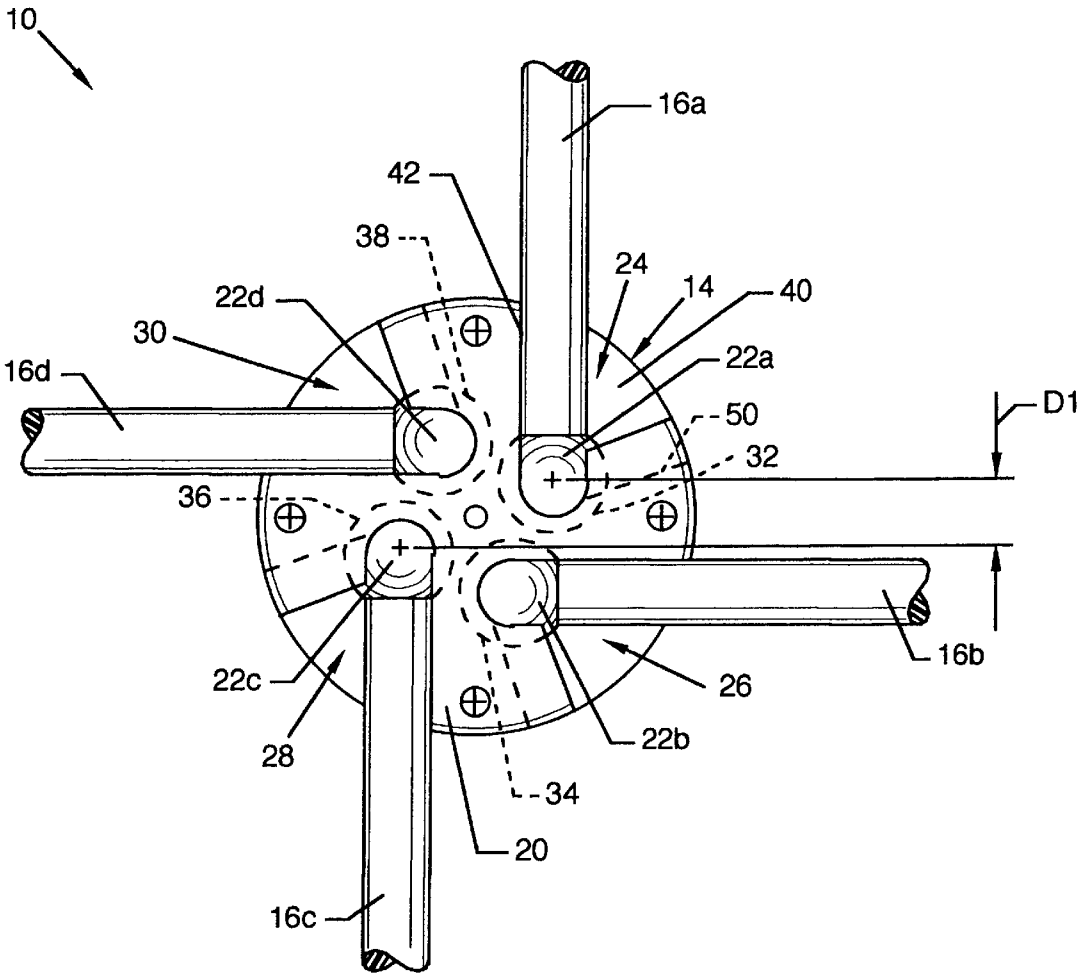
FIG. 7 illustrates a bottom view of the hub accommodating the inboard ends of a plurality of struts.

FIG. 7 illustrates a bottom view of the hub 14 accommodating the inboard ends of struts 16*a*–16*d*. The outboard ends of the struts 16*a*–16*d* extend to the end of a panel such as panel 12 shown in FIG. 1 and are secured or captured thereto or therein. The struts 16*a*–16*d* are rotated, for purposes of illustration and example, to the fullest counterclockwise position about the respective ball ends 22*a* –22*d*, and are limited in travel in a counterclockwise position by one side such as the arced surface 42 of the accommodational maneuvering channels 24, 26, 28 and 30, respectively, and to also lie against the planar surfaces of the accommodational maneuvering channels 24, 26, 28 and 30, such as planar surface 40. In addition, the inboard strut ends of the struts 16*a*–16*d* are also aligned to the truncated slots 46. The position of the struts 16*a*–16*d* is shown in the relaxed and non-actuated position and the hub 14 is also shown in the relaxed and non-actuated position. Also referenced in the drawing is distance D1, being the distance between the centers of the ball ends 22*a* and 22*c* in the unactuated position.

Figure 8:
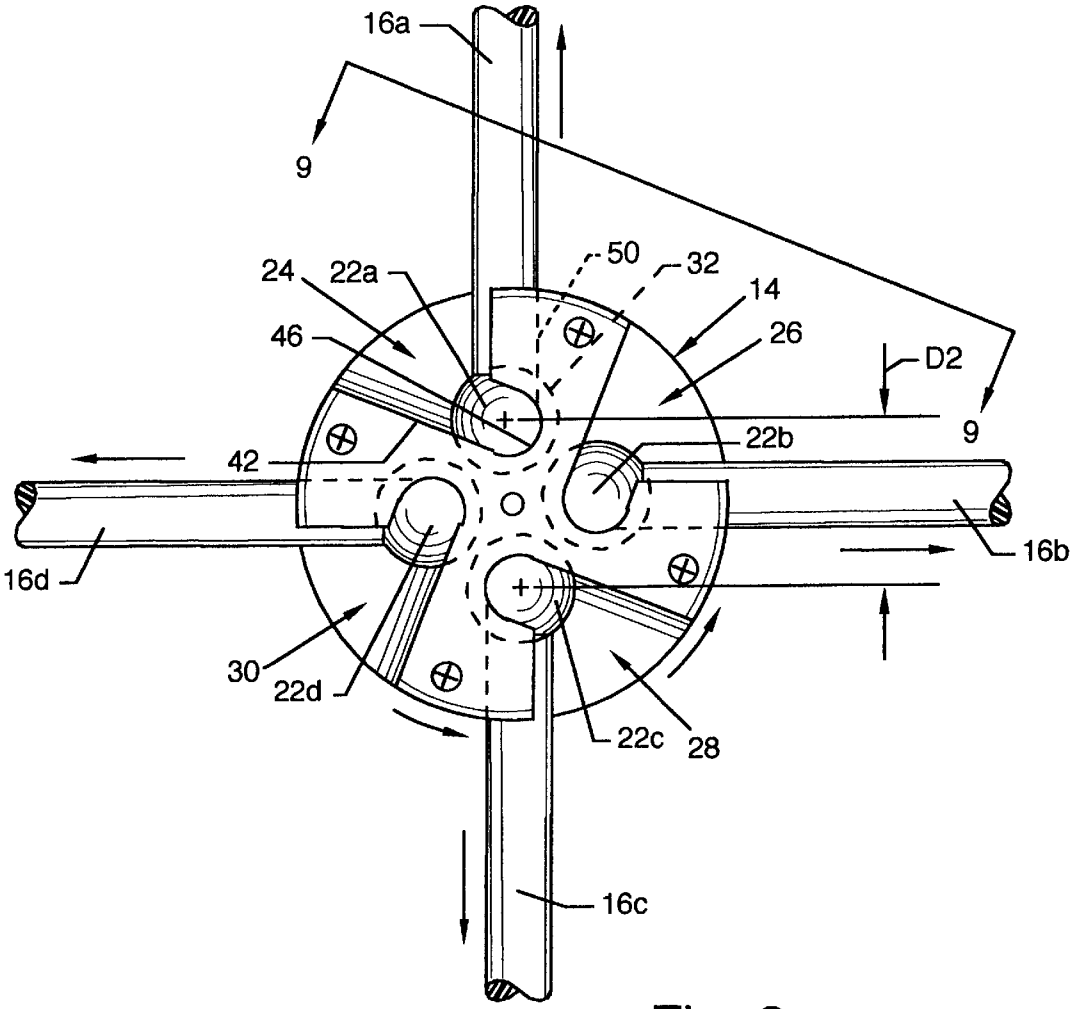
FIG. 8 illustrates a bottom view of the hub rotated counterclockwise, as viewed from the bottom, to outwardly position the struts.

FIG. 8 illustrates a bottom view of the hub 14 rotated counterclockwise, as viewed from the bottom, to outwardly position struts 16*a*–16*d* and tighten an accompanying panel 12. As the hub 14 is rotated counterclockwise about its center, the ball ends are likewise urged in a counterclockwise direction. At the same time a new distance D2 between the ball ends 22*a* and 22*c* is created, that distance being larger than distance D1 in the previous FIG. 7. With respect to and comparison of the old distance D1 and the new distance D2, it can be seen that the ball ends 22*a* and 22*c* (and ball ends 22*b* and 22*d*) and thus the struts 16*a* and 16*c* (and the struts 16*b* and 16*d*) are further distanced to create a new and increased distance from the outboard tips of the struts 16*a*–16*d* which is applied to the outward reaches of the panel 12. The struts 16*a*–16*d* are locked by (1) snappingly engaging the capture detents 50 and, (2) over-the-center positioning of opposing strut set 16*a* and 16*c* and strut set 16*b* and 16*d* with relation to each other. At full counter-rotation of the hub 14, the inboard portion of the strut 16*a* and the remaining struts 16*b*–16*d* align in the capture detents 50, typical to the accommodational maneuvering channels 24, 26, 28 and 30, to opposingly lock over-the-center and positionally fix the struts 16*a*–16*d* with respect to the hub 14 and to each other.

Figure 9:
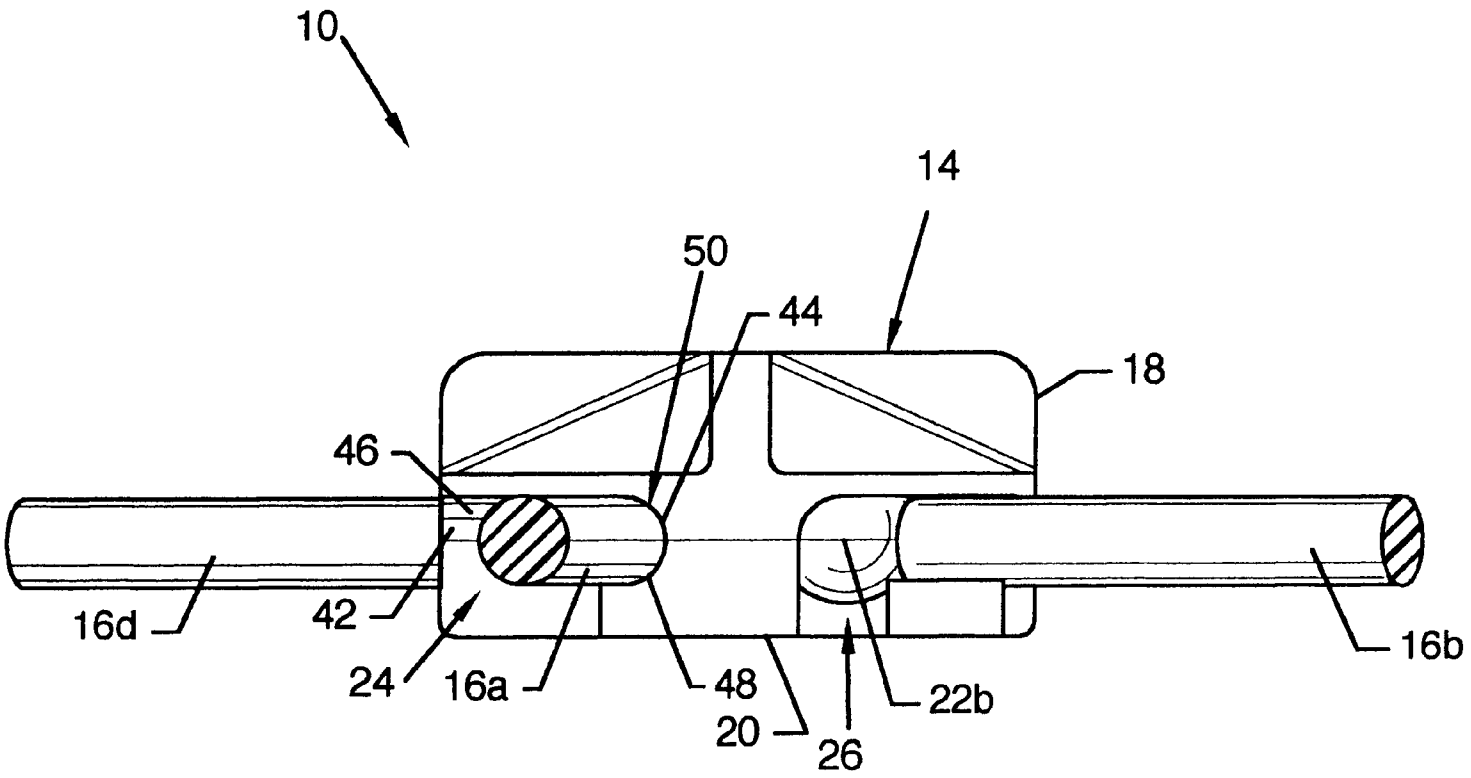
FIG. 9 illustrates a side view of the cam style hub and strut system along line 9—9 of FIG. 8 having the struts locked in the extended position by the hub; and, FIG. 10 illustrates a side view of the cam style hub and strut system where the hub has been rotated clockwise to disengage and unlock the struts from the over-the-center lock mode and from the capture detents.

FIG. 9 illustrates a side view of the cam style hub and strut system 10 along line 9—9 of FIG. 8 having the struts 16*a*–16*d* locked in the extended position by the hub 14, where all numerals correspond to those elements previously described. Particularly noted is the strut 16*a* which is captured by the capture detent 50. The elasticity of the hub material is such that entry of and exit from the capture detents 50 by the struts 16*a*–16*d* is accomplished with a nominal amount of rotational pressure as applied to the hub 14 for engagement or disengagement of the hub 14 with the struts 16*a*–16*d*.

Figure 10:
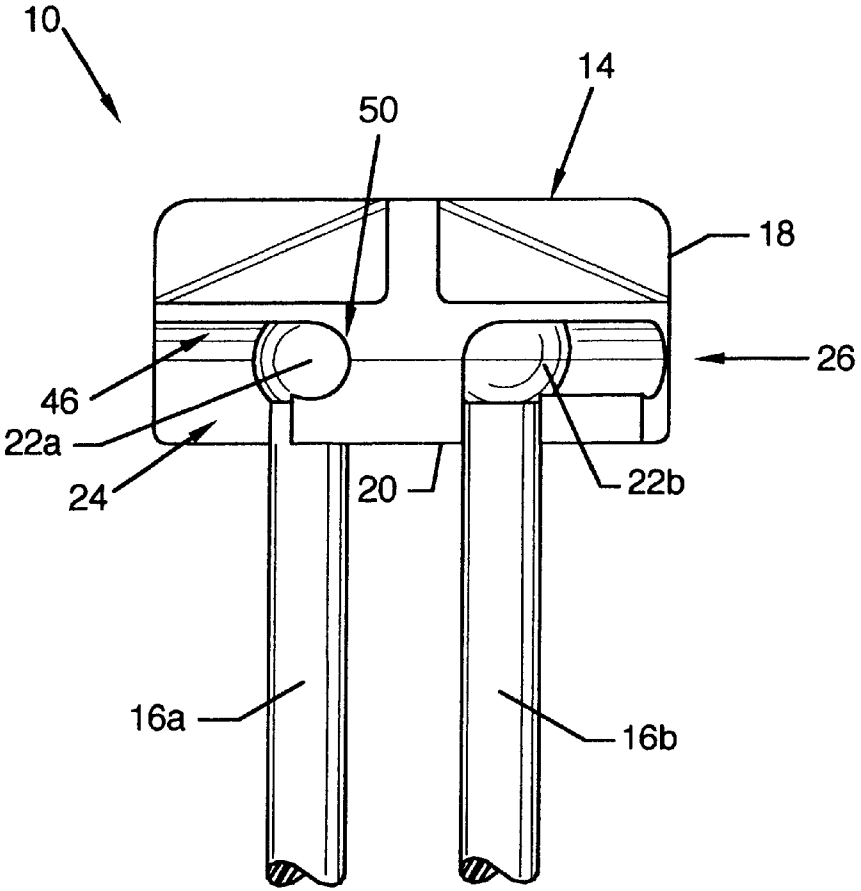

FIG. 10 illustrates a side view of the cam style hub and strut system 10 where the hub 14 has been rotated clockwise to disengage and unlock the struts 16*a*–16*d* from the over-the-center lock mode and from the capture detents 50, where all numerals correspond to those elements previously described. The hub 14 can be rotated to the full clockwise position positioning the inboard ends of the struts 16*a*–16*d* fully away from the capture detents 50, thus aligning the inboard ends of the struts 16*a*–16*d* to the opposing arced surfaces 42 at the ends of the accommodational maneuvering channels 24, 26, 28 and 30 which also places the inboard ends of the struts 16*a*–16*d* in alignment with the truncated slots 46. Positioning of the inboard ends of the struts 16*a*–16*d* in the truncated slots 46 allows yet another positioning of the struts 16*a*–16*d* in the vertical position, as shown, for collapsing of the struts 16*a*–16*d* and the panel 12 attached thereto.

Various modifications can be made to the present invention without departing from the apparent scope hereof.

What is claimed is:

1. A cam style hub and strut system for use in portable and semi-permanent structures, comprising:

a. a hub consisting of two parts fixedly connected together so as to be capable of movement together as a unit but incapable of movement independently of one another, one of said two parts being an actuator handle and the other of said two parts being a capture plate;

b. a plurality of accommodational maneuvering channels provided in said hub at equal intervals spaced around the periphery of said hub, each accommodational maneuvering channel including a slot which opens to the bottom of said capture plate, a ball-shaped socket formed partially in said actuator handle and partially in said capture plate; and, c. a plurality of struts equal in number to the number of accommodational maneuvering channels, each strut having a ball end residing in a respective one of said ball-shaped sockets, each ball end being confined within its respective ball-shaped socket by juxtaposed, confronting surfaces of said actuator handle and said capture plate which press against said ball ends.

* * * * *